United States Patent [19]

Guttinger et al.

[11] 4,186,797

[45] Feb. 5, 1980

[54] DUAL-BELT COOLING SYSTEM

[75] Inventors: Manfred Guttinger, Stuttgart; Konrad Schermutzki, Schmiden, both of Fed. Rep. of Germany

[73] Assignee: Sandco Limited, Ottawa, Canada

[21] Appl. No.: 789,663

[22] Filed: Apr. 21, 1977

Related U.S. Application Data

[63] Continuation of Ser. No. 585,823, Jun. 11, 1975, abandoned.

[30] Foreign Application Priority Data

Jun. 12, 1974 [DE] Fed. Rep. of Germany ..... 2428292

[51] Int. Cl.[2] ..... F28F 25/06

[52] U.S. Cl. ..... 165/120; 100/154; 62/380

[58] Field of Search ..... 165/120; 62/63, 380, 62/374; 100/154; 109/99 P

[56] References Cited

U.S. PATENT DOCUMENTS

| | | | |
|---|---|---|---|
| 1,822,124 | 9/1931 | Birdseye | 165/120 |
| 2,274,284 | 2/1942 | Vore | 62/63 |
| 2,286,514 | 6/1942 | Stebbins | 62/380 |
| 3,300,994 | 1/1967 | Bagge-Lund | 62/380 |
| 3,405,531 | 10/1968 | Davis, Jr. et al. | 62/380 |
| 3,620,158 | 11/1971 | Torelli et al. | 100/154 |
| 3,672,181 | 6/1972 | Tyree, Jr. | 62/380 |
| 3,808,092 | 4/1974 | Buster | 100/154 X |

FOREIGN PATENT DOCUMENTS

| | | | |
|---|---|---|---|
| 722272 | 7/1942 | Fed. Rep. of Germany | 165/120 |

*Primary Examiner*—Samuel Scott
*Assistant Examiner*—Theophil W. Streule, Jr.
*Attorney, Agent, or Firm*—Harold L. Stults; William S. Frommer

[57] ABSTRACT

A dual-belt system for cooling a continuous layer or strip of a product. A treatment zone is formed by co-extensive runs of two endless steel belts, which are mounted upon end rolls and are positioned in predetermined relationship. The coolant liquid exerts the desired pressure on the layer of the product to insure the proper heat-exchange relationship between the product and the coolant. The cooling liquid is supplied to headers having a belt run as one wall, and variations in the thickness of the layer of the product do not change the pressure exerted on the product.

5 Claims, 4 Drawing Figures

DUAL-BELT COOLING SYSTEM

This is a continuation, of application Ser. No. 585,823, filed June 11, 1975 abandoned.

This invention relates to a dual-belt cooling system with two impervious endless belts which are carried over end rolls and have mating runs which move together with a treatment zone between them and with those runs being cooled by a liquid.

In known dual-belt cooling systems, liquid coolant is supplied to spray-nozzle arrangements disposed between the upper and lower runs of the belt loops, which spray cooling brine upon the upper surface of the lower run of the upper belt and the bottom surface downward-facing of the upper run of the lower belt. The cooling brine collects in a catch basin located between the runs of the lower belt loop. In order to prevent the liquid coolant from damaging the product being cooled, drip strips are provided along the edges of the two belts.

The prior-art dual-belt cooling systems have the drawback that a specific contact pressure cannot be maintained between the coextensive belt runs in the cooling zone, with the result that heat removal by contact cooling is not uniform and not particularly effective. In addition, the spraying process usually requires a fairly high water pressure, which requires special means for producing the pressure. Also, the water spray may erode the belts and other components against which it is directed.

It is an object of the present invention to provide improved dual-belt cooling systems. To that end, it is an object to provide such systems in which a controlled heat-exchange relationship is provided between the liquid coolant and the product. A further object is to provide for the above with constructions which are adaptable to varying conditions of operation and use, and which are efficient and dependable at all times. These and other objects will be in part obvious and in part pointed out below.

In accordance with the present invention, a body of the liquid coolant is confined within a header upon the upper surface of the lower run of an upper belt, and exerts an evenly distributed constant pressure upon the belt run. Within the treatment zone, the coextensive (upper) run of the lower belt is supported in fixed relationship, so that the pressure of the cooling liquid is exerted upon the product throughout the cooling zone. Variations in the thickness of the layer of the product are accommodated by the flexing of the upper belt run with the pressure exerted on the product being unchanged. That insures an acceptable heat-exchange relationship between the product and the liquid coolant at all times.

Referring to the drawings, wherein two illustrative embodiments of the invention are shown somewhat schematically:

Figure 1:
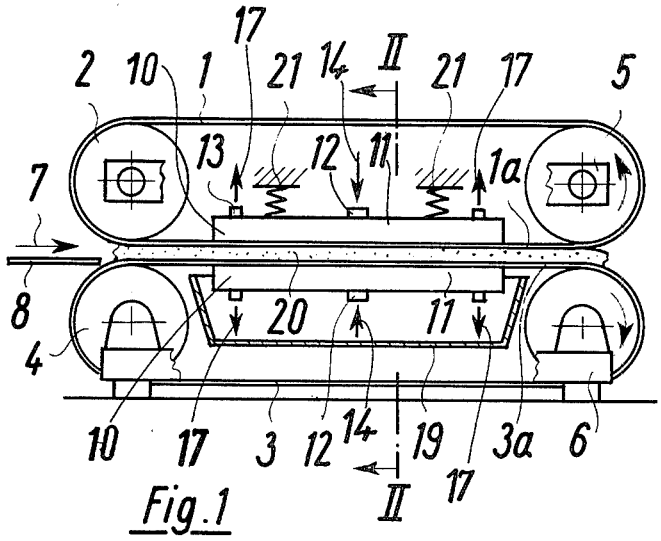
FIG. 1 is a simplified schematic side elevation of one embodiment.
Figure 2:
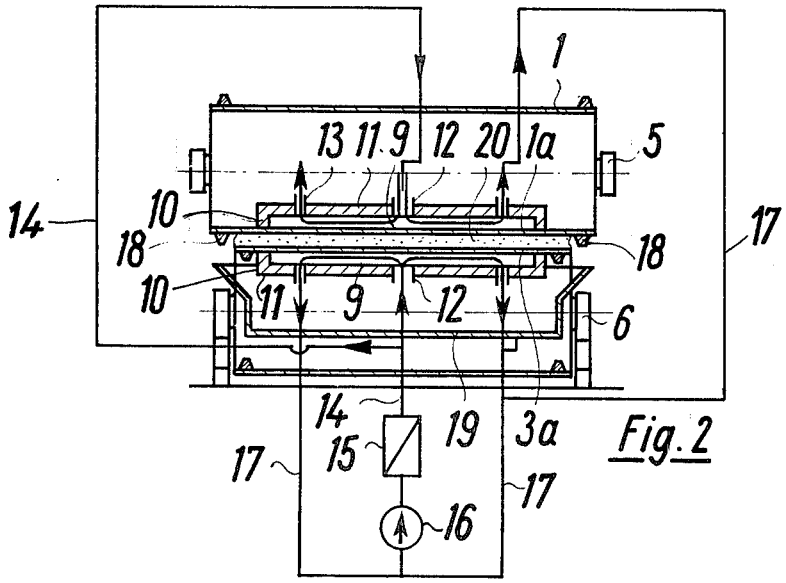
FIG. 2 is a simplified schematic vertical section on line II—II of FIG. 1.

Referring to FIG. 1 and 2 of the drawings, the cooling system has upper and lower endless steel belts 1 and 3 having coextensive runs 1*a* and 3*a*, respectively. Belt

3 is mounted upon end rolls 4 which are mounted in fixed relationship, and the belt is driven by an electric motor drive unit (not shown). Belt 1 is mounted upon a pair of end rolls 2 which are adjustable vertically to control the thickness of the treatment zone between the belt runs 1*a* and 3*a*, and belt 1 is driven by an electric motor drive unit (not shown) at the same speed as belt 3.

Positioned below belt run 3*a* is a lower header box 11 which is formed by a rectangular bottom wall and a peripheral vertical wall structure 10 (see FIG. 2) which extends upwardly from the bottom wall and has flat top surfaces which rest against the bottom surface of belt run 3*a*. Positioned above belt run 1*a* is an upper similar header box 11 formed by a rectangular top wall and downwardly directed side walls 10. Side walls 10 have flat bottom surfaces which rest against the top surface of belt run 1*a*, and are aligned with walls 10 of the lower header box. Each of the header boxes provides a liquid seal with its belt run so as to cooperate with its belt run to form a closed header with the belt run forming a heat exchange wall. The bottom header box is held in fixed position, but the upper header box is urged downwardly by a pair of compression springs 21, so that the portions of the belt runs between the aligned peripheral walls of the header boxes are pressed toward each other by the spring pressure. A stream of liquid coolant is supplied to each of the header boxes from a conduit 14 through a central coolant inlet port 12, and the coolant is discharged from each of the header boxes to conduits 17 through four discharge ports 13 adjacent the respective corners of the header boxes. The coolant is circulated by a pump 16 (FIG. 2) which directs the stream through a heat exchanger 15 which cools the liquid and thence through conduits 14, and the coolant is returned to pump 16 from discharge ports 13 through conduits 17.

A continuous product layer 20 which is being cooled passes into the treatment zone at 7 from a feed table 8, and the cooled product is discharged at the right. As indicated above, the header boxes provide a liquid seal with their respective belt runs. However, any liquid which seeps from either of the header boxes along the surface of its belt run is directed downwardly by resilient side strips 18 mounted on the belts, and is collected in a tank 19 positioned between the runs of belt 3. The liquid so collected is returned to pump 16 through a conduit 17 under the control of a valve (not shown) which has a float which maintains a liquid seal to its conduit.

Pump 16 maintains a controlled pressure head in conduit 14 and that pressure is such as to provide the desired fluid pressure against the belt runs throughout the cooling zones formed by the header boxes. That is, each header box forms the closed header 9 to which the coolant is supplied and from which it is discharged through outlet ports 13 at a flow rate to provide an acceptable header pressure. The flow rate is such as to produce the desired cooling of the product as it passes through the treatment zone. Within the header, the coolant flows somewhat radially from the inlet ports 12 to the respective outlet ports 13.

If variations occur in the thickness of the product layer 20, the bodies of coolant in the two headers exert constant pressure upon the belts, urging the belts toward each other where the product is of lesser thickness and permitting the belts to move from each other where the product layer is of greater thickness. That insures the desired heat exchange relationship between the product and the coolant and the removal of the heat from the product. It tends to compact the product layer, if it is not held together tightly.

Figure 3:
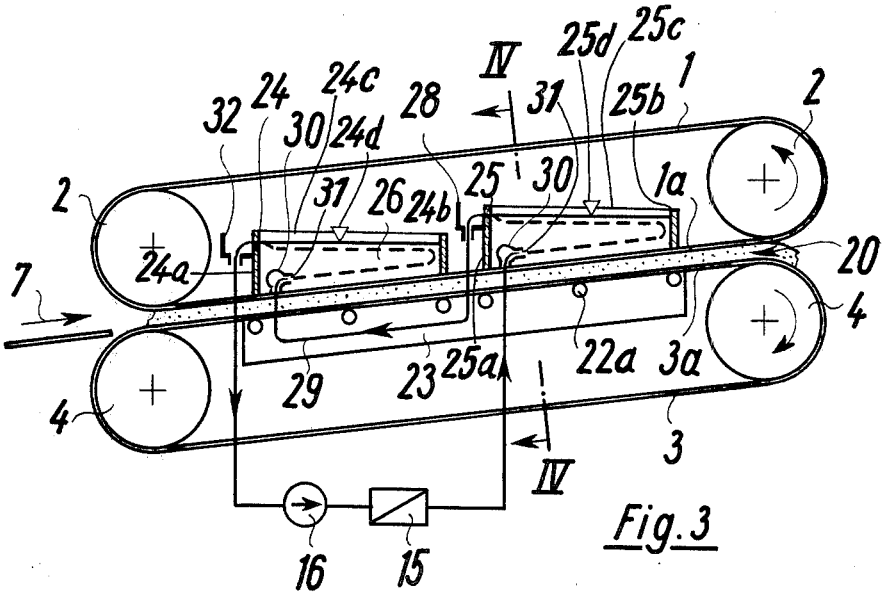
FIG. 3 is similar to FIG. 1, but shows another embodiment.
Figure 4:
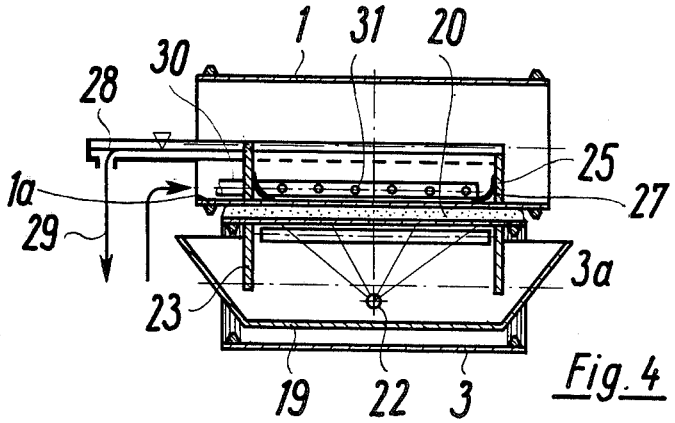
FIG. 4 is similar to FIG. 2 and is a view on line IV—IV of FIG. 3.

In the embodiment of FIGS. 3 and 4, the arrangement of the belts and rolls is essentially the same as in FIGS. 1 and 2, except as will be pointed out. The belt runs are at an angle to the horizontal so that the product moves upwardly through the treatment zone, and belt run 3*a* is supported by rollers 22*a* and is cooled by a spray assembly 22. The upper belt run 1*a* is provided with two coolant header 24 and 25 which are open-topped tanks extending across the width of the belt and formed by vertical walls. Coolant is supplied to each of these headers through a pipe 30 having jet outlets 31 which direct the coolant along the general flow path represented by the broken line first along the belt run and then back along the top of the header. The left-hand wall 24*a* is at a lower level than the right-hand wall 24*b* and the side walls 24*c*, and the liquid level indicated at 24*d* is maintained by wall 24*a* acting as a weir over which the coolant is discharged into a trough 32. Header 25 is similarly constructed so that the coolant is discharged from it into a trough 28. The coolant from trough 28 flows through a conduit 29 to pipe 30 in header 24, and the coolant from trough 32 flows to the pump 16 which directs the coolant through the heat exchanger 15 back to pipe 30 in header 25. With this arrangement the lowest temperature coolant is along the downstream portion of the treatment zone where the product has been partially cooled, and the warmer coolant is at the portion of the treatment zone where the product enters. Hence, there is stepped cooling of the product.

In this embodiment, the lower belt run 3*a* provides a fixed support so that variations in the thickness of the product layer are accommodated solely by the movement of belt run 1*a* to and from belt run 3*a*. Also, the hydrostatic pressure of the coolant in the liquid headers is sufficient to insure an acceptable heat-exchange relationship between the coolant and the product layer. Simultaneously, the spray cooling for belt run 3*a* is efficient because the product layer is always urged downwardly against belt run 3*a*.

In each of the embodiments disclosed above, the lower belt can be extended at the inlet end to permit the product to be deposited on the belt, thus making it unnecessary to provide the feed table 8. It is understood that other modifications may be made in the embodiments herein disclosed and that other embodiments may be provided incorporating the invention, all within the scope of the claims. In each of the illustrating embodiments, the flow paths of the coolant in the headers is generally parallel to the movement of the product. It is understood that the flow paths will be such as to provide the desired cooling rates along the product strip, taking into account the characteristics of the heat exchanger 15 or other chiller for the coolant.

What is claimed is:

1. A dual-belt cooling system which includes two endless metal belts and four end rolls upon which the belts are mounted one above the other with coextensive runs of the belts forming a cooling zone therebetween through which a product passes in heat-exchange relationship with both of said belts, said belt runs extending at an angle with respect to the horizontal; means for supporting the lower of said coextensive belt runs; header means for providing stepped cooling of said product, said header means comprising a plurality of cooling frames arranged in series in the direction of belt travel, each of said cooling frames including an open top structure seated above the upper of said coextensive belt runs and being in fluid sealed relationship therewith, means for discharging a liquid coolant in each of said cooling frames such that said liquid in each frame is in substantially fluid sealed relationship with said upper of said coextensive belt runs to produce cooling and a controlled pressure within each of said cooling frames such that said liquid performs the dual function of cooling said product and exerting a pressure on said upper of said coextensive belt runs so as to urge said upper run against the product, the liquid level in the second cooling frame in the series being higher than the liquid level in the first of said cooling frames in cascade fashion, and a coolant flow connection between the two cooling frames so that liquid coolant discharged from one frame is introduced into the other.

2. A dual-belt cooling system as defined in claim 1, wherein said cooling frames are provided with coolant overflow means of which that of the second cooling frame is connected to theinlet of the first cooling frame.

3. A dual-belt cooling system as defined in claim 2, wherein said means to discharge coolant in each of said cooling frames comprises a pipe and at least one jet outlet terminating below the liquid level.

4. A dual-belt cooling system as defined in claim 1, wherein both of said belts are arranged so that at least said coextensive belt runs slope upwardly in the direction of the series of cooling frames.

5. A dual-belt cooling system as defined in claim 3, wherein said first cooling frame is connected through its outlet to a coolant flow path which includes a heat exchanger and a circulating pump and the inlet of the last cooling frame in the series is connected to said heat exchanger.

* * * * *